United States Patent [19]

Yang

[11] Patent Number: 4,763,887

[45] Date of Patent: Aug. 16, 1988

[54] ADJUSTABLE RANGE VISE

[76] Inventor: Tai-Her Yang, 5-1 Taipin St., Si-Hu Town, Dzan-Hwa, Taiwan

[21] Appl. No.: 943,774

[22] Filed: Dec. 19, 1986

[51] Int. Cl.[4] ..... B25B 1/10

[52] U.S. Cl. ..... 269/247

[58] Field of Search ..... 269/165, 172, 297, 139, 269/207-215

[56] References Cited

U.S. PATENT DOCUMENTS

| | | | |
|---|---|---|---|
| 488,600 | 12/1892 | Cowell | 269/172 |
| 807,788 | 12/1905 | Stetler | 269/139 |
| 4,070,010 | 1/1978 | Brasca | 269/247 |

*Primary Examiner*—Robert C. Watson

*Attorney, Agent, or Firm*—Leonard Bloom

[57] ABSTRACT

An adjustable range vise is disclosed having a pair of clamping jaws, each of which is independently movable. Each jaw is carried by a respective horizontal slide. A first horizontal slide is received in a slot formed in one end of a fixed vise body, extending at least partially therethrough. A second horizontal slide is received in a mortise which is formed in a second opposite end of the vise body, extending at least partially therethrough. The mortise and the slot are positioned on separate substantially parallel planes, one above the other and on the same substantially vertical plane. The slides move horizontally, in opposite directions "overlapping" one another when needed. One of the jaws can be selectively adjustably secured, prior to clamping providing an adjustable clamping range or distance. This permits the size of the vise body to be reduced while still providing a sufficient clamping distance.

2 Claims, 6 Drawing Sheets

ADJUSTABLE RANGE VISE

FIELD OF THE INVENTION

The present invention relates to vises and, in particular, a vise having a selectively adjustable clamping range which permits the vise to have a body length that is substantially less than its maximum clamping distance.

BACKGROUND OF THE INVENTION

When people work, first thing they have to do is to stabilize an object (workpiece). They must then process (work) the object (workpiece) with utensils. Stabilizing the object by clamping is specifically important while working. This clamping is often performed with the use of vises.

An ordinary vise sold in a market consists of one fixed body (jaw) and one movable body (jaw) including a sliding structure and a leading shaft that drives the movable jaw to clamp. Therefore, usually, the clamping distance of a vise is limited by the size of its structure (its body length). If a longer clamping distance is needed, a longer size vise (a vise having a longer body length) must be used. This causes inconvenience in package and such a vise occupies more space when utilized and stored. Also, a big size vise is heavier in weight and occupies more space.

Due to these restraints in the structure of the vise, as well as its weight and the space it occupies, the ordinary vise, described above, has a maximum body size and a maximum clamping distance which is practical to use. Conventional vises cannot be enlarged substantially, so that its clamping distance is not substantially greater than its body length.

Alternatively, because of the various sizes of objects which need to be clamped, various sized vises are sold. This can be costly and can also create problems with space and storage.

SUMMARY OF THE INVENTION

It is a primary object of the present ivention to break through the traditional structural limitation of common vises by providing a vise having a front movable clamp jaw system and a rear movable clamp jaw system.

This design employs multiple-layer, paralleled upper and lower dual movement system to enlarge sliding range. This structural design shortens the body length of the vise that can clamp the same size object as the above stated two parts structured vise which consists of a fixed body and a movable body.

The improved design minimizes its size (body length) and, consequently, the space it occupies. Moreover, this design can speed up the adjustment for a longer object and is more convenient to use.

This design, mainly by including at least one sliding socket (horizontal slide) which is received in the fixed body and which carries what, in a traditional vise, would be the fixed jaw.

This sliding socket mounts on (is received in) a vertical mortise of a fixed body and enables itself to make an adjusting slide. The position adjusting holes on it determines its relation with the fixed body.

Inside this middle sliding socket, there is an inner sliding rail which snaps to the root part of the movable jaw. There is also a fixed threaded opening shaft base (an upwardly extending, internally threaded lug) into which a leading threaded shaft (an externally threaded screw rod) can be screwed and drives a movable jaw to perform a clamping or releasing function together with another jaw.

One step ahead, another design is to have a parallel upper and lower system. That is, a first movable jaw having an independent driving threaded shaft (an externally threaded screw rod) and a second movable jaw with an independent driving threaded shaft (screw rod) that is separately received in a second, parallel mortise formed in the same fixed body in parallel. This enlarges the ratio available between the clamping size and the space the vise occupies (its body size). It widens a clamping extent of a clamp structure.

In accordance with the teachings of the present invention, there is disclosed an adjustable range vise which includes a first clamping jaw a second clamping jaw. A fixed vise body supports said first and second clamping jaws. This vise further has a first end and a second opposite end. A substantially horizontal mortise is formed in the first end of the vise and extends at least partially through said body. A substantially horizontal slot is formed in the second end of the vise. This slot extends at least partially through said body. The horizontal mortise and the horizontal slot are positioned on separate, substantially parallel planes. The plane on which the slot is positioned is located above the mortise. The mortise and the slot are further positioned on the same, substantially vertical plane. A first upwardly-extending lug is provided having an internally threaded bore formed therethrough. This first lug is positioned in the slot. A second upwardly-extending lug is provided having an internally threaded bore formed therethrough. This second lug is positioned in the mortise. A first horizontal slide includes a first end which is received in the slot for sliding movement therein in a first direction into the slot and in a second, opposite direction out of the slot. The first slide also includes a second, opposite end having the first clamping jaw carried thereon for concomitant movement with the first slide. A second horizontal slide includes a first end which is received in the mortise for sliding movement therein in the said first direction out of the mortise and in the said second, opposite direction into the mortise. The second slide further includes a second, opposite end which has the second clamping jaw carried thereon for concomitant sliding movement with the second slide. A first threaded screw rod is rotatably journaled in the first slide, whereby the first slide is carried thereon. This first screw rod is externally threaded, such that the threads thereof engage and cooperate with the internal threads of the first lug. In this fashion, rotational movement of the first screw rod in a first direction moves the first screw rod and the first slide in the first direction. Further, in this fashion, rotational movement of the first screw rod in a second opposite direction moves the first screw rod and the first slide in the second opposite direction. A second threaded screw rod is rotatably journaled in the second slide, whereby the second slide is carried thereon. This second screw rod is externally threaded, such that the threads thereof engage and cooperate with the internal threads of the second lug. In this fashion, rotational movement of the second screw rod in the first direction moves the second screw rod and the second slide which is thereon in the second direction. Further, in this fashion, rotational movement of the second screw rod in the second opposite direction moves the second screw rod and the second slide in the first direction. Finally, means is provided for selectively securing one of the first or second slides and the respective clamping jaw carried thereon in a selectively adjustable stationary position prior to sliding movement of the other of the first or second slides and the respective clamping jaw carried thereon.

Preferably, the slot has a flared portion and the first slide is dove-tailed in shape. Formed thusly, the dove-tailed slide is received in the flared slot forming a dove-tail joint therebetween.

DETAILED DESCRIPTION OF THE INVENTION

A traditional vise normally has a constant clamping distance. Because of this, there has been always some limitation on practical application. This design, by including a sliding socket (a horizontal slide) which is received on a sliding surface formed in the fixed body and which carries thereon what, in a traditional vise would be the fixed jaw enlarges its clamping extent.

For example, the original clamping area of from 0 to 100 mm is enlarged to have multiple function areas from 0 to 100 mm, from 100 to 200 mm, from 200 to 300 mm. Following are the practical implementation examples of which this design is applied to various type of vises.

There is a middle vertical sliding rail between a fixed body and a movable body. There are two types: A movable jaw is in the front or a movable jaw which consists of a pigeon tail (dove tail) shaped groove is in the rear.

Figures 1, 1A:
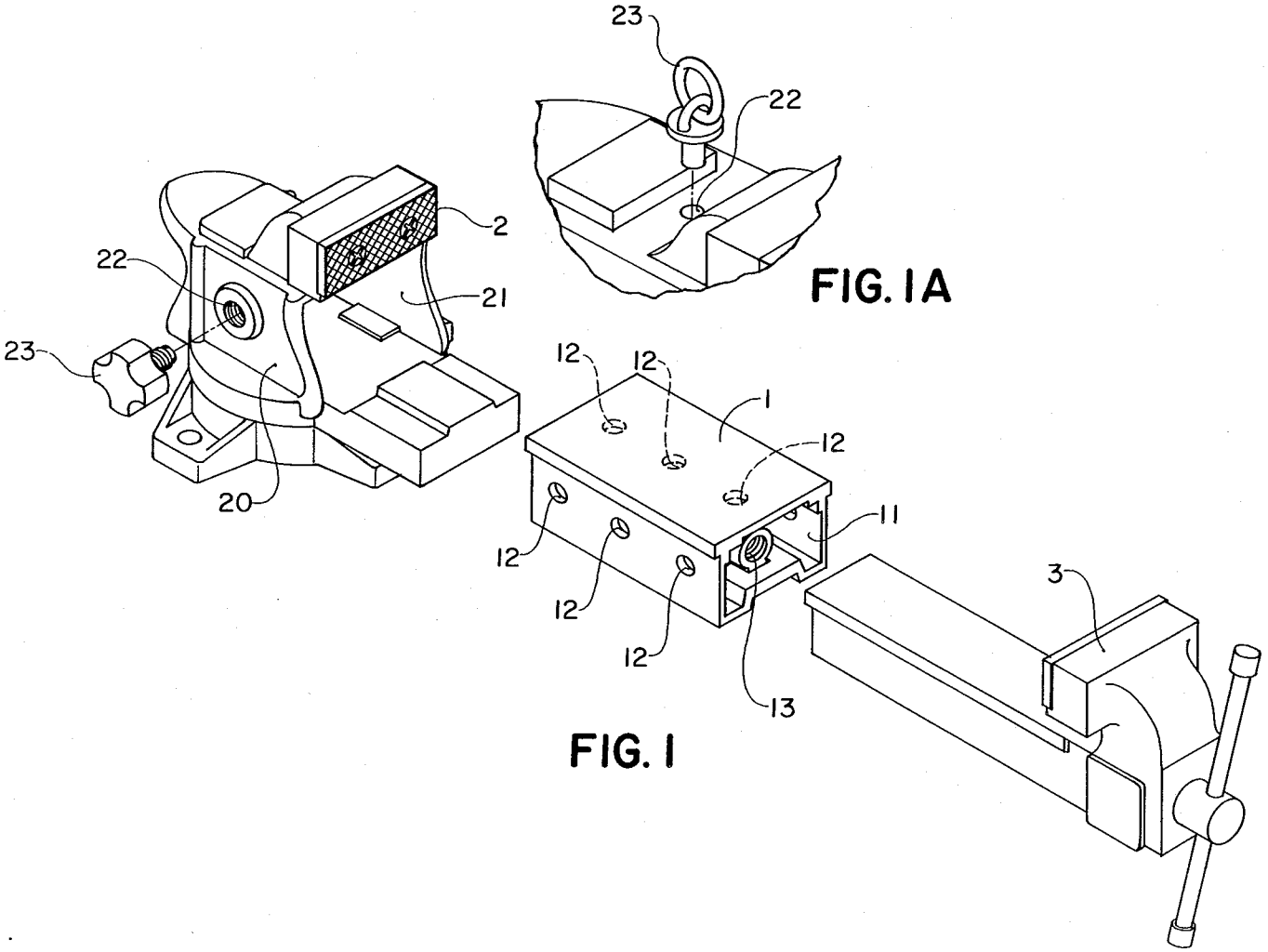
FIG. 1. A solid, dissolved structural view of a front movable jaw.
Figure 2:
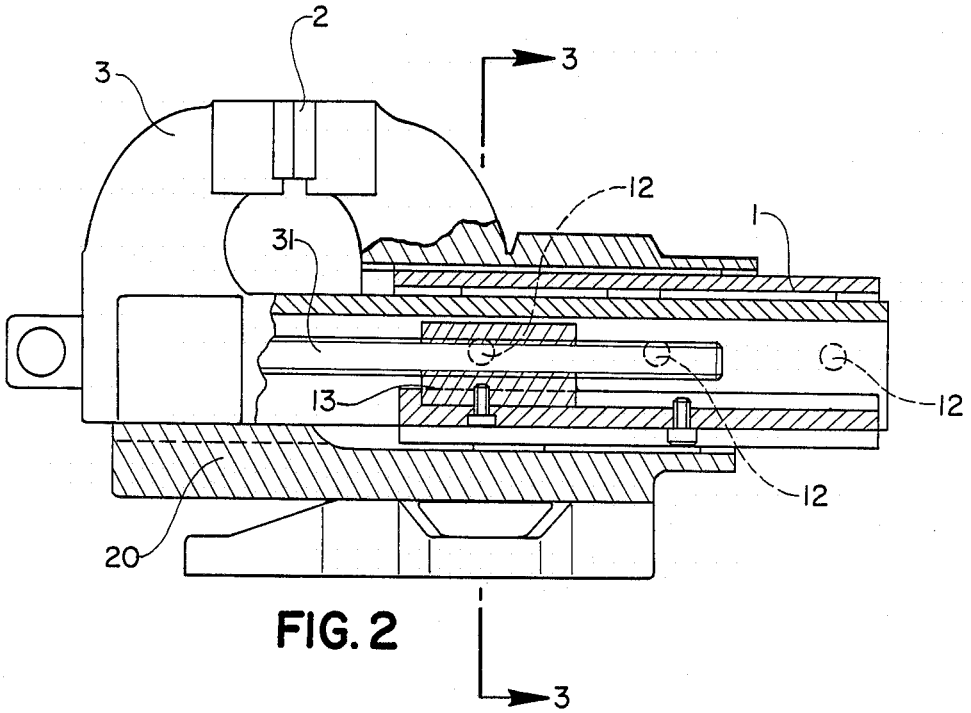
FIG. 2. A sectional view of a front movable jaw structure.
Figure 3:
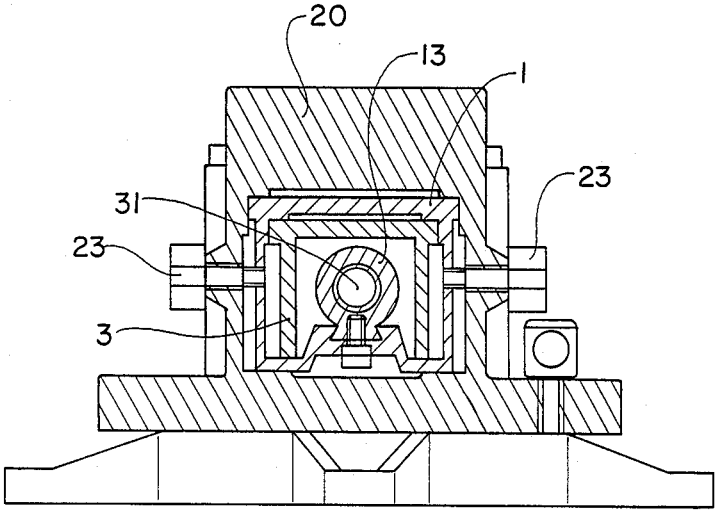
FIG. 3. A sectional view of A—A in the FIG. 2.

Following figures are various implementation examples:

FIGS. 1, 2 and 3 show the structural example that this design is applied to a front movable jaw which is driven by a leading threaded shaft. In the figures, there is the third middle sliding socket 1 consisting of at least one layer between a fixed clamp body and a movable body. By adjusting the distance between a middle socket 1 and a fixed jaw 2, the clamping extent between a movable jaw 3 and a fixed jaw 2 can be changed. Its main structural feature include:

One set of a fixed vise body 20 is affixed on a work table. A fixed jaw 2 that performs the function of clamping face is on it. Its main body has a vertical sliding rail 21 that accepts a middle sliding socket 1 and a hole 22 into which a position locking bolt 23 can be screwed to lock a sliding socket 1.

This position fixing hole 22 may be set on both sides of the main body or on its top part.

At least one set of a middle sliding socket is placed in a middle, vertical sliding rail 21 of a fixed body 20 and enables to adjust itself by a sliding movement. On its top or both sides, there are at least two position locking holes 12 to screw position fixing bolts 23.

The position locking bolts 23 performs the function of adjusting its distance with a fixed body 2. There is a vertical sliding rail 11 inside for a sliding root portion of a movable jaw 3 to be placed in it. (In case there are multiple layers, it snaps on the next middle sliding socket.) There is also a shaft base 13 with a threaded hole for inserting a threaded shaft 31 that drives a movable jaw 3.

There is a piercing opening on a movable jaw 3 to insert a driving leading threaded shaft 31. A leading threaded shaft 31 is screwed in a threaded hole of a shaft base 13 in a middle sliding socket 1. Its root portion is snapped into a sliding rail 11 of a middle sliding socket 1. By driving a leading shaft, its clamp holding surface and a clamp holding face of a fixed body 2 perform a tight clamping or releasing action.

A driving threaded shaft 31 is used to drive a movable jaw 3 and allow a middle sliding socket 1 to make the facing movement.

A position locking bolt 23 is used to lock the adjusted position between a middle sliding socket 1 and a fixed body 2.

When it is put into a practical application, a position locking bolt 23 functions as a selector of the location of a fixed body 2 and a middle sliding socket 1. Because it does not obstruct the relation between a middle sliding socket 1 and a movable jaw 3, it may be applied to increase or decrease the extent of a clamping area.

For example, to clamp a larger work object, it can be done by just extending a middle sliding socket 1 in the direction of a movable jaw 3. It is effective to clamp a general work object, such as a work object with a larger frame.

Figure 4:
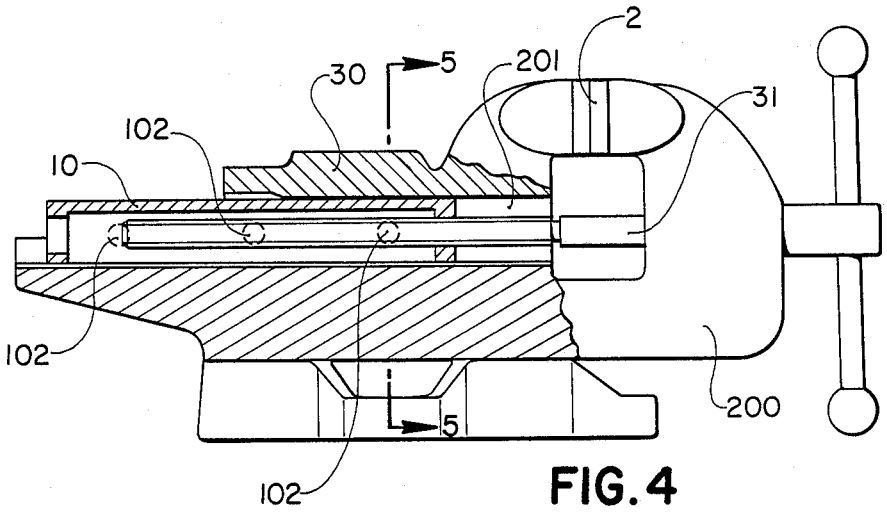
FIG. 4. A sectional view of a rear movable jaw structure.
Figure 5:
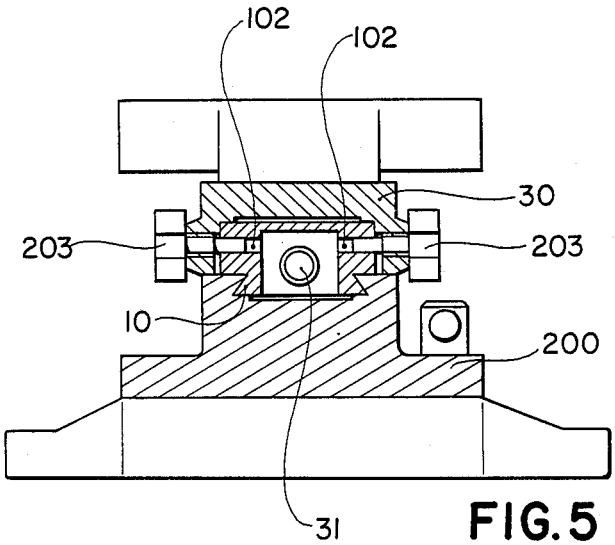
FIG. 5. A sectional view of B—B in the FIG. 4.

The FIGS. 4 and 5 show the structure that this design is applied to drive a rear movable jaw 30 with a leading threaded shaft 31. In the figure, the main part is that between a vise fixing body 200 and a movable body 30, attach a position adjustable third middle sliding socket 10 that has at least one layer. By adjusting the distance between a middle socket 10 and a movable jaw 30, the clamping area between a movable jaw 30 and a fixed jaw 2 can be adjusted. Its main structural features include:

One set of a vise fixing body 200 is attached on a work table. On it, there is one clamping face A that is a fixed jaw 2. On the back part of the main body, there is a vertical, pigeon tail shaped rail 201 for snapping a middle sliding socket 10.

At least one set of a middle sliding socket 10 is snapped in a vertical sliding rail 201 inside a fixed body 200. An adjusting drive is performed by driving a threaded shaft 31. On it, there are at least two sets of position locking holes 102. The distance of a movable jaw 30 is adjusted by a position locking threaded bolt 203. Also there is a vertical second sliding rail to snap the bottom part of a movable jaw 30. (In case of multiple layers, to snap the next middle sliding socket.) There is a threaded hole to screw in a threaded shaft 31 that will be used to drive.

On the top or both sides of a movable jaw 30, there are holes into which threaded bolts 203 are screwed for locking the position of a middle sliding socket 10. Its root portion is used to snap a sliding rail of a middle sliding socket 10. The above stated position locking holes 102 and a position locking threaded bolts 203 function to adjust the distance of a middle sliding socket 10.

A driving threaded shaft 31 issued to drive a middle sliding socket 10 and activate the clamping surfaces A of a movable jaw and a fixed body 200 to make a movement toward each other.

A position locking threaded bolt 203 is used to lock the pre-selected position between a middle sliding socket 10 and a movable jaw 30. Its practical application is the same as the above stated FIG. 1. A repeating explanation is avoided here.

Figure 6:
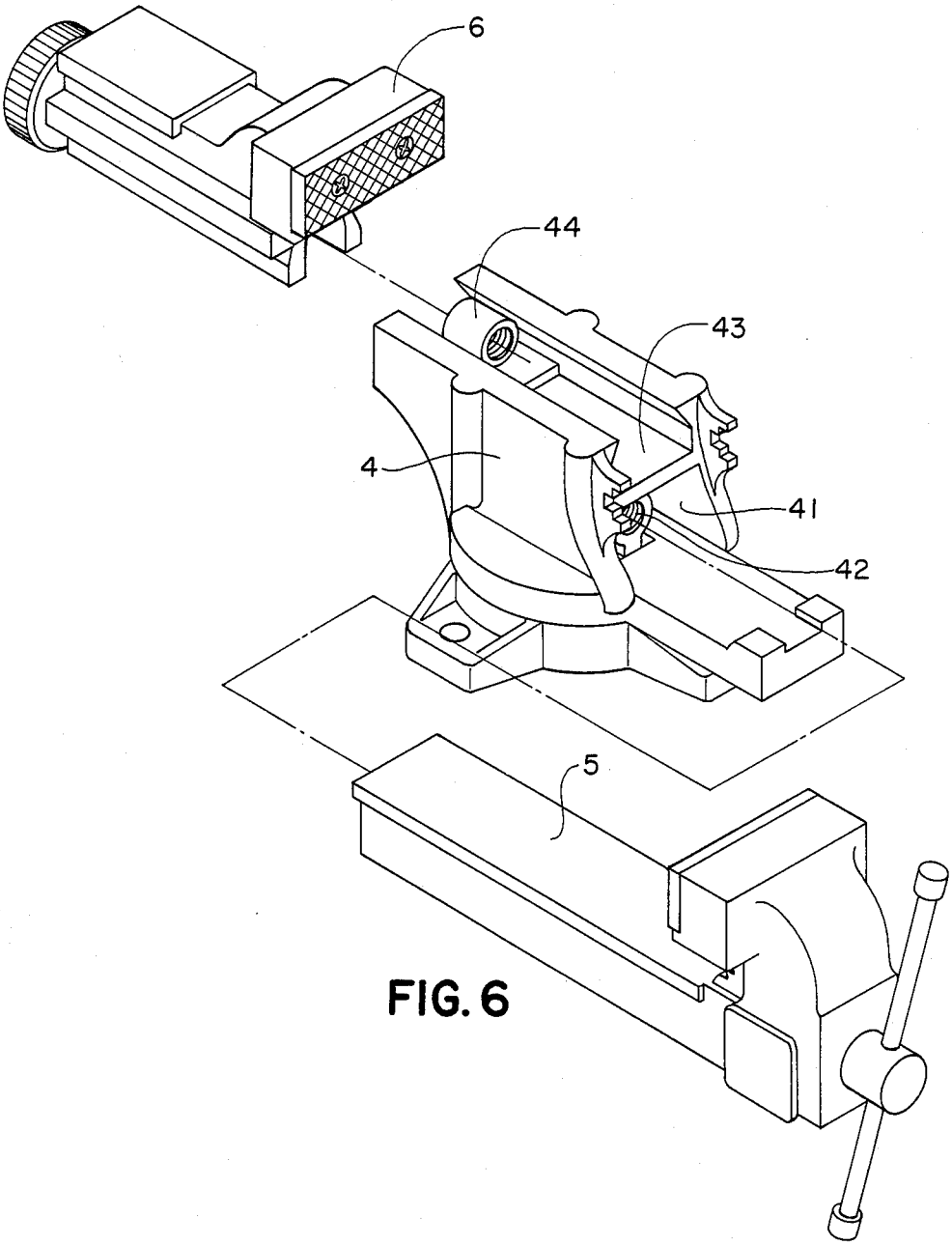
FIG. 6. A solid, dissolved structural view of a front and rear movable jaws sharing a fixed body.
Figure 7:
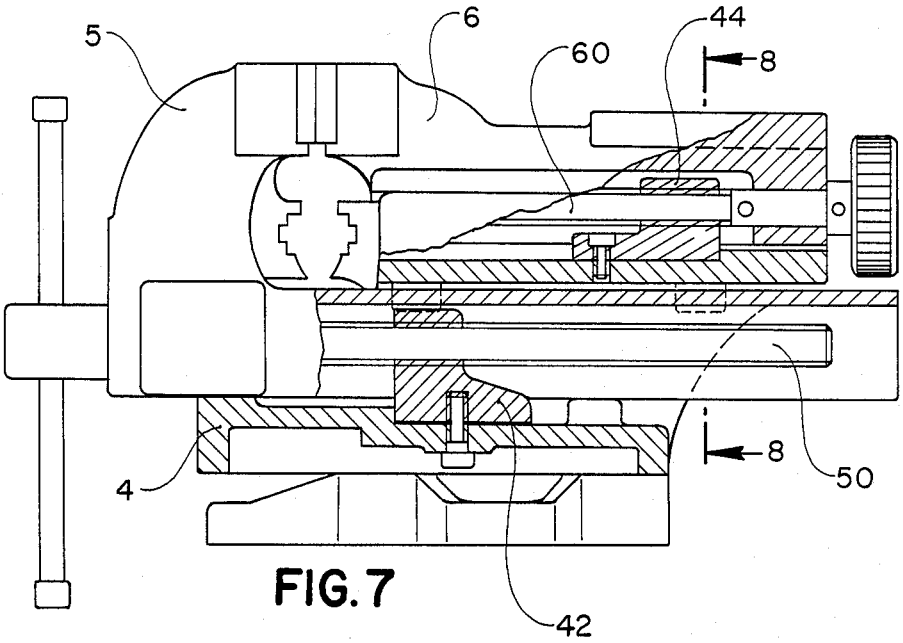
FIG. 7. A sectional view of a front and rear movable jaws sharing a fixed body.
Figure 8:
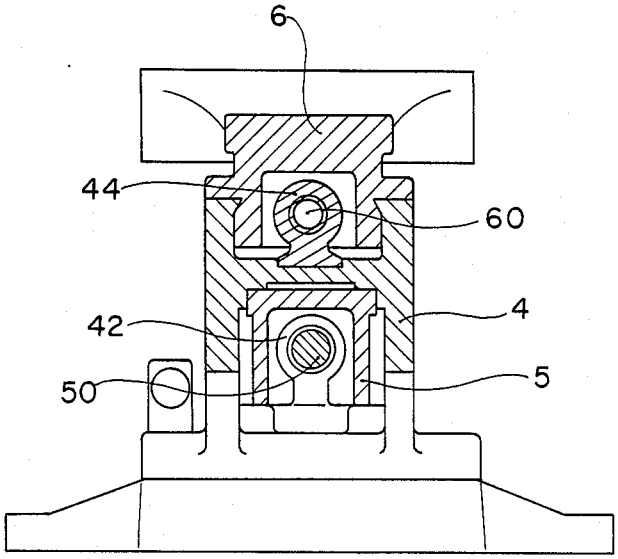
FIG. 8. A sectional view of C—C in the FIG. 7.

The FIGS. 6, 7 and 8 show the structure of this design, one step ahead.

A front (first) movable jaw and a rear (second) movable jaw share one common fixing body (fixed vise body) 4. On the bottom portion of a fixed main body 4, there is a sliding hole (mortise) 41 wherein a second horizontal slide having the second movable (clamping) jaw 5 is inserted and to make a sliding movement.

Inside the sliding hole (mortise) 41, there is a front shaft base (second upwardly-extending lug) 42 which has a threaded hole (an internally threaded bore) formed therethrough. A vertical, pigeon tail (dove-tail) shaped groove (slot) 43 is made on a fixed body 4 to receive therein a first horizontal slide which carries a first clamping movable jaw 6. Inside the pigeon tail (dove-tail) shaped groove (slot) 43, there is another rear shaft base (first upwardly-extending lug) 44 which has a threaded hole (an internally threaded bore).

On the top of a front (second) movable (clamping) jaw 5, there is a clamping surface facing inward. A piercing opening is drilled on the front bottom part to insert (in which is rotatably journaled) a front leading threaded shaft (second threaded screw rod) 50 and is received in and cooperates with a front shaft base (second lug) 42 inside a fixed body (the fixed vise body) 4. A front leading threaded shaft (second screw rod) 50 has a larger head portion that can produce the pressing function against a front movable jaw (second clamping jaw) when it is turned to clamp.

A stop pin spring and a detent are installed on the exposing section of the piercing hole inner side wall. It is used to activate the retreat of the front movable jaw (second clamping jaw) under a counter-wise turning (rotational turning in a first direction).

On a rear movable (first clamping) jaw 6, there is a clamping surface that faces a clamping surface of a front movable (second clamping) jaw 5. On the bottom part of the first horizontal slide there is a slidable pigeon tail (dove tail) which snaps into the pigeon tail (dove tail) shaped groove (slot) 43 of the fixed body 4. Its end portion extends downward, and has a piercing hole to insert (in which is rotatably journaled) a rear leading threaded shaft (first threaded screw rod) 60. This leading threaded shaft (first screw rod) 60 is screwed into (engages and cooperates with) a shaft base (first upwardly-extending lug) 44 which is located between the top side of a fixed body 4 and the pigeon tail (dove tail) shaped groove (slot) 43. There is a larger head part on its outer end which functions to press and clamp tightly when the first slide having the first movable clamping jaw 6 is turned and pressed.

A stop pin spring and a detent is installed on the exposing section of the piercing hole inner side wall. It is used to activate the retreat of the first slide having the first movable jaw thereon under a counter-wise turning (rotational turning in a second, opposite direction). Thus turning a rear leading threaded shaft (first screw rod) 60, it activates a rear movable jaw (first clamping jaw) 6.

In the above stated structure, the same threaded groove distance shafts may be applied to two sets of the leading threaded shafts (screw rods) 50 and 60 for producing the clamping power. Or one step ahead, one set uses a fine threaded shaft and the other set uses a coarse threaded shaft. A coarse threaded shaft is used for rough adjustment and a fine threaded shaft is used to produce the stronger clamping power under the same turning torque.

Figure 9:
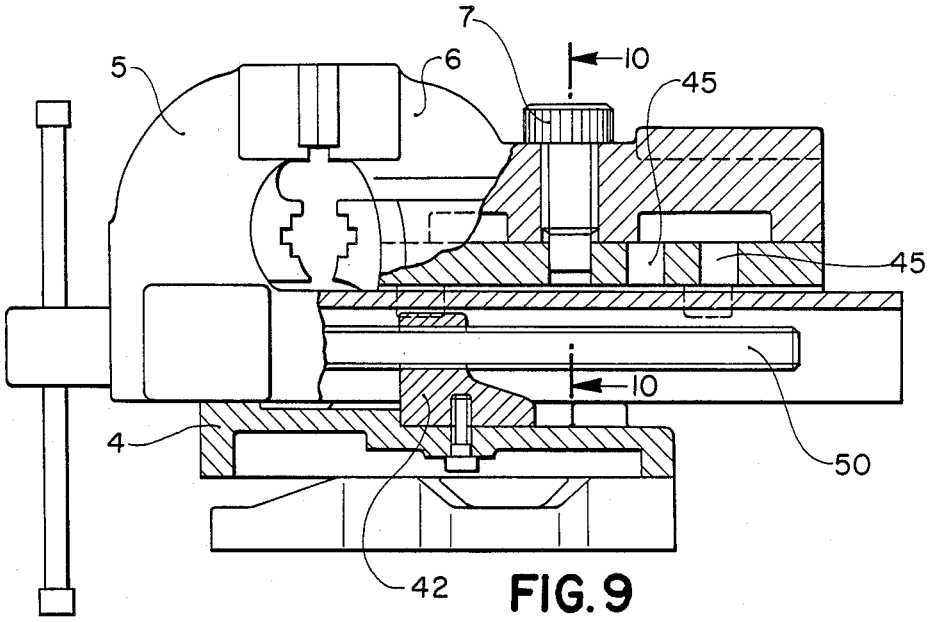
FIG. 9. A sectional view of another implementation example of a front and rear movable jaws sharing a fixed body.
Figure 10:
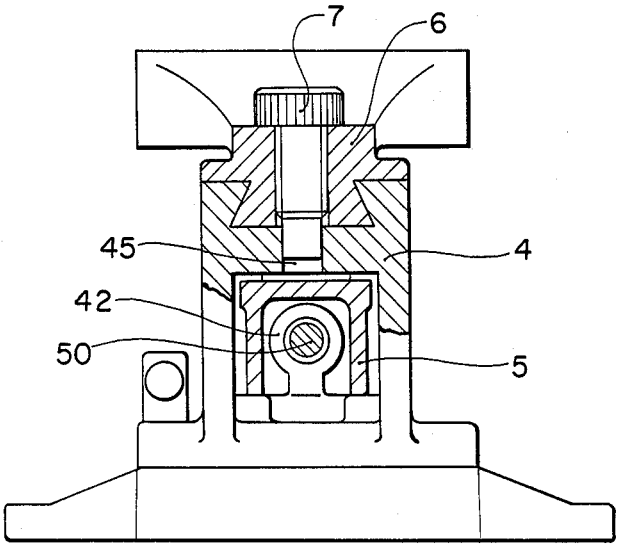
FIG. 10. A sectional view of D—D in the FIG. 9.

In the practical application, we find the fact that this design, under the same weight and space, it has a larger clamp holding size. The above stated rear sliding jaw 6, one step ahead, may have the specific features as shown in the FIGS. 9 and 10. Eliminate a rear leading threaded shaft 60 and a rear shaft base 44, make one position locking threaded and stepped hole between a jaw and a flat surface. Make at least two vertical position locking holes 45 on a pigeon tail shaped groove of the fixed body 4. By inserting a threaded position locking bolt 7 into the above stated position locking threaded and stepped hole on a rear sliding jaw 6 and one of the pre-selected position locking holes 45 on the fixed body 4, the adjustment between a rear movement jaw 6 and a fixed body 4 can be made.

Summing up, this application, by adding a middle sliding socket to adjust the extent, enlarges the applicable area for a vise. It is economical.

I claim:

1. An adjustable range vise, comprising:

a first clamping jaw;

a second clamping jaw;

a fixed vise body for supporting said first and second clamping jaws, said vise further having a first end and a second opposite end;

a substantially horizontal mortise formed in the first end of the vise and extending at least partially through said body;

a substantially horizontal slot formed in the second end of the vise and extending at least partially through said body;

the horizontal mortise and the horizontal slot being positioned on separate, substantially parallel planes, the plane on which the slot is positioned beng located above the mortise, said mortise and said slot being further positioned on the same, substantially vertical plane;

a first upwardly-extending lug having an internally threaded bore formed therethrough, said first lug being positioned in the slot;

a second upwardly-extending lug having an internally threaded bore formed therethrough, said second lug being positioned in the mortise;

a first horizontal slide including a first end received in the slot for sliding movement therein in a first direction into the slot and in a second, opposite direction out of the slot, the first slide including a second, opposite end having the first clamping jaw carried thereon for concomitant movement with the first slide;

a second horizontal slide including a first end received in the mortise for sliding movement therein in the said first direction out of the mortise and in the said second, opposite direction into the mortise, the second slide further including a second, opposite concomitant sliding movement with the second slide;

a first threaded screw rod rotatably journaled in the first slide, whereby the first slide is carried thereon, said first screw rod being externally threaded, such that the threads thereof engage and cooperate with the internal threads of the first lug, whereby rotational movement of the first screw rod in a first direction moves the first screw rod and the first slide in the first direction, and further whereby rotational movement of the first screw rod in a second opposite direction moves the first screw rod and the first slide in the second opposite direction;

a second threaded screw rod, rotatably journaled in the second slide, whereby the second slide is carried thereon, said second screw rod being externally threaded, such that the threads thereof engage and cooperate with the internal threads of the second lug, whereby rotational movement of the second screw rod in the first direction moves the second screw rod and the second slide thereon in the second direction, and further whereby rotational movement of the second screw rod in the second opposite direction moves the second screw rod and the second slide in the first direction; and means for selectively securing one of the first or second slides and the respective clamping jaw carried thereon in a selectively adjustable stationary position prior to sliding movement of the other of the first or second slides and the respective clamping jaw carried thereon.

2. The adjustable range vise of claim 1, wherein the slot has a flared portion and further wherein the first slide is dove-tailed in shape, such that the dove-tailed slide is received in the flared slot forming a dove-tail joint therebetween.

* * * * *